US006782829B1

(12) United States Patent
Han et al.

(10) Patent No.: US 6,782,829 B1
(45) Date of Patent: Aug. 31, 2004

(54) NON-LETHAL CARGO PROJECTILE

(75) Inventors: Seungeuk Han, Fort Lee, NJ (US); Raymond Trohanowsky, Mt.Tabor, NJ (US); Andrew Ponikowski, Clifton, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 10/707,307

(22) Filed: Dec. 4, 2003

(51) Int. Cl.[7] ..... F42B 12/68
(52) U.S. Cl. ..... 102/504; 102/387; 102/489
(58) Field of Search ..... 102/504, 489, 102/387

(56) References Cited

U.S. PATENT DOCUMENTS 3,715,668 A * 2/1973 Herring et al. ..... 455/96
3,867,893 A * 2/1975 Saholf et al. ..... 114/20.1
4,372,215 A * 2/1983 Crepin ..... 102/387
5,109,774 A * 5/1992 Deffayet ..... 102/382

FOREIGN PATENT DOCUMENTS

DE 3326877 * 2/1985

* cited by examiner

*Primary Examiner*—Charles T. Jordan
*Assistant Examiner*—T. Nguyen
(74) *Attorney, Agent, or Firm*—Robert Charles Beam; Michael C. Sachs; John F. Moran

(57) ABSTRACT

A non-lethal cargo projectile includes a projectile body; a nose cap attached to a front of the projectile body; a boattail attached to a rear of the projectile body; a fin assembly including a boom attached to the boattail; a parachute assembly disposed in a front of the projectile body; a cable connecting the parachute assembly to the boattail; a fuze disposed in the boattail; a first pair of half cylinders disposed in the projectile body behind the parachute assembly; a first circular disc disposed at a front end of the first pair of half cylinders and a second circular disc disposed at a rear end of the first pair of half cylinders; a second pair of half cylinders disposed in the projectile body in front of the first circular disc enclose the parachute assembly; and a payload disposed in a space defined by the first pair of half cylinders and the first and second circular discs.

10 Claims, 3 Drawing Sheets

NON-LETHAL CARGO PROJECTILE

FEDERAL RESEARCH STATEMENT

The inventions described herein may be manufactured, used and licensed by or for the U.S. Government for U.S. Government purposes.

BACKGROUND OF INVENTION

The invention relates in general to munitions and in particular to cargo projectiles that dispense a payload and descend to the ground at a predetermined velocity, which velocity is scaleable for various non-lethal cargo applications.

The specific problem solved by the invention is controlling the descent rate of a projectile shell that is used for delivering various non-lethal payloads. Non-lethal projectiles should be non-lethal in every aspect. However, conventional non-lethal applications deliver non-lethal payloads using regular projectile cargo shells that descend at high speed with a significant weight and a lethal kinetic energy. For crowd dispersion or riot control, it may be desirable to deliver, from a remote distance, a payload such as tear gas or malodorant pellets. While it is desired to disperse the crowd or control the riot, it is not desired to kill or seriously injure anyone. A problem arises when delivering the payload with conventional munition shells, which impact the ground with a full impact velocity that is converted to lethal kinetic energy. Therefore, there is a need for projectile shells that deliver non-lethal payloads to be equipped with non-lethal capability. The present invention renders a cargo projectile shell non-lethal by reducing its descent rate with a conventional parachute application.

The present invention uses a conventional projectile shell body, such as but not limited to, an 81 mm illumination mortar. The deployment sequence starts with launch, then flight, then fuze detonation in air at a preset time at a predetermined height and location. Then, the payload is ejected and the projectile shell body descends to the ground. Therefore, the inventive projectile should be strong enough to be launched under high G-forces and able to meet the range requirements for a mission need. The invention uses an aerodynamic decelerator system known as a parachute to decelerate the cargo projectile shell to minimize its impact velocity, thus minimizing impact kinetic energy. A fuze can be located in either the front or rear of the projectile, depending on missions and types of projectile. For most finners, as in the case of the 81 mm illumination mortar cartridge, the projectile is stabilized by a fin assembly. The decelerator system and payload are more conveniently and efficiently ejected through the nose of the projectile. In this application, the fuze is more effectively located in the rear of the projectile (boattail) to push the payload and decelerator system forward through the nose. The decelerator system is attached to the cargo projectile shell and will bring the body to the ground at a predetermined descent rate. The descent rate is determined by the size and type of decelerator system, and can be tailored for any application requirement

SUMMARY OF INVENTION

It has now been discovered that the above and other objects of the present invention may be accomplished in the following manner. Specifically, design and test work have proven that a single parachute decelerator system can recover the ammunition cargo projectile shell and descend it at a predetermined rate so its kinetic energy meets the non-lethal requirement. Thus, this invention can be used on ammunitions intended for non-lethal missions. The invention is for delivering a payload, dispersing the payload by functioning the fuze located in the rear of the projectile, and recovering the projectile shell using a single parachute decelerator system at a predetermined descent rate.

The invention will be better understood, and further objects, features, and advantages thereof will become more apparent from the following description of the preferred embodiments, taken in conjunction with the accompanying drawings.

BRIEF DESCRIPTION OF DRAWINGS

In the drawings, which are not necessarily to scale, like or corresponding parts are denoted by like or corresponding reference numerals.

DETAILED DESCRIPTION

Figure 1:
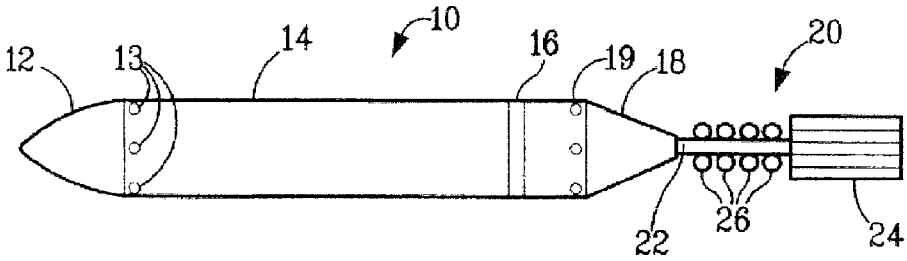
FIG. 1 is a side view of a non-lethal cargo projectile.
Figure 2:
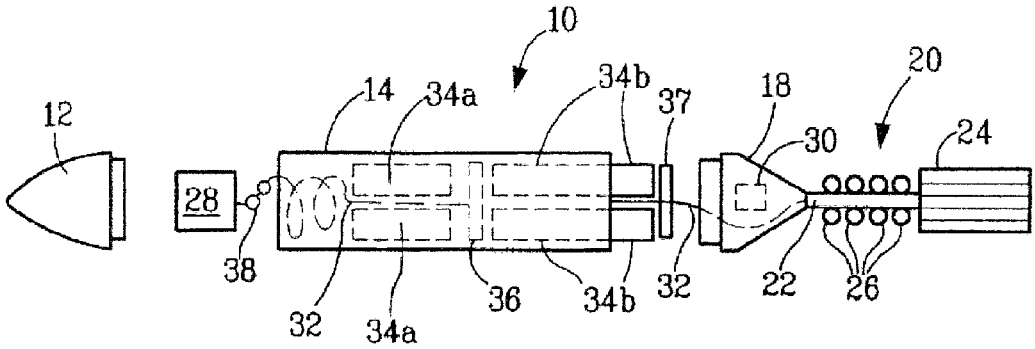
FIG. 2 is an exploded view of the projectile of FIG. 1.
Figure 3:
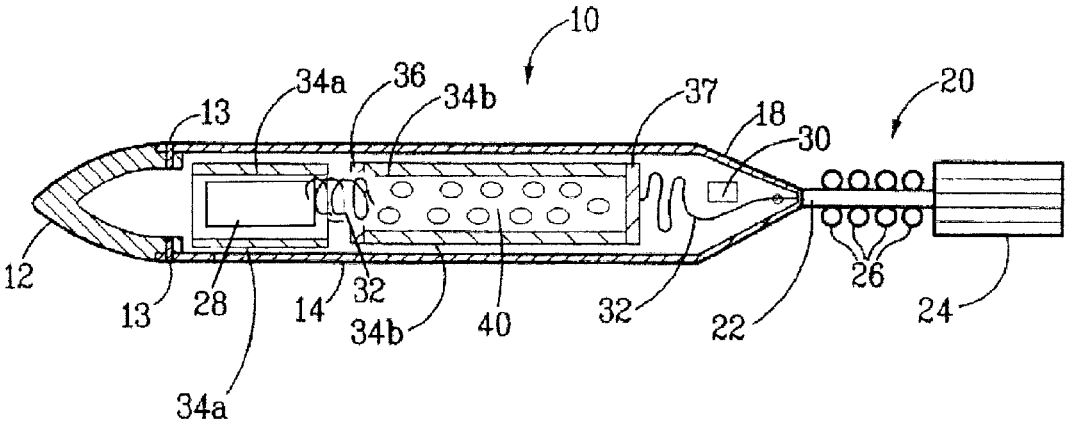
FIG. 3 is a view, partially in section, of the projectile of FIG. 1.

FIG. 1 is a side view of one embodiment of a non-lethal cargo projectile 10. FIG. 2 is an exploded view of the projectile 10 of FIG. 1. FIG. 3 is a view, partially in section, of the projectile 10 of FIG. 1. Referring now to FIGS. 1–3, a non-lethal cargo projectile 10 is shown. Projectile 10 comprises a projectile body 14; a nose cap 12 attached to the front of the projectile body 14; a boattail 18 attached to the rear of the projectile body 14; a fin assembly 20 including a boom 22 attached to the boattail 18; a parachute assembly 28 disposed in the front of the projectile body 14; a cable 32 that connects the parachute assembly 28 to the boattail 18; a fuze 30 disposed in the boattail 18; a first pair of half cylinders **34*b*, 34*b* disposed in the projectile body 14 behind the parachute assembly 28; a first circular disc 36 disposed at the front end of the first pair of half cylinders 34*b*, 34*b* and a second circular disc 37 disposed at the rear end the first pair of half cylinders 34*b*, 34*b*; a second pair of half cylinders 34*a*, 34*a*; enclose parachute 28 disposed in the projectile body 14 in front of the first circular disc 36; and a payload 40 disposed in the space defined by the first pair of half cylinders 34*b*, 34*b* and the first and second circular discs 36, 37**.

Projectile 10 further comprises shear pins 13 that connect the nose cap 12 to the front of the projectile body 14. Shear pins 13 may be made of, for example, nylon, wood, or bronze, depending on the desired strength. A plurality of propellant donuts 26 are disposed in a known manner on the boom 22. A swivel 38 connects the cable 32 to the parachute assembly 28. Swivel 38 helps prevent entanglement of the parachute assembly 28, cable 32 and projectile body 14. Fuze 30 is preprogrammed and includes a charge for producing gas. The charge in fuze 30 may be, for example, black powder. The payload 40 is of a non-lethal nature, for example, crowd control devices such as tear gas pellets or malodorant pellets.

The nose cap 12 which is reserved for filler space, and half cylinders **34*a* and 34*b* are made of, for example, plastic. The projectile body 14 is made of, for example, aluminum. The first and second circular discs 36, 37** are made of, for example, aluminum.

Figure 4A:
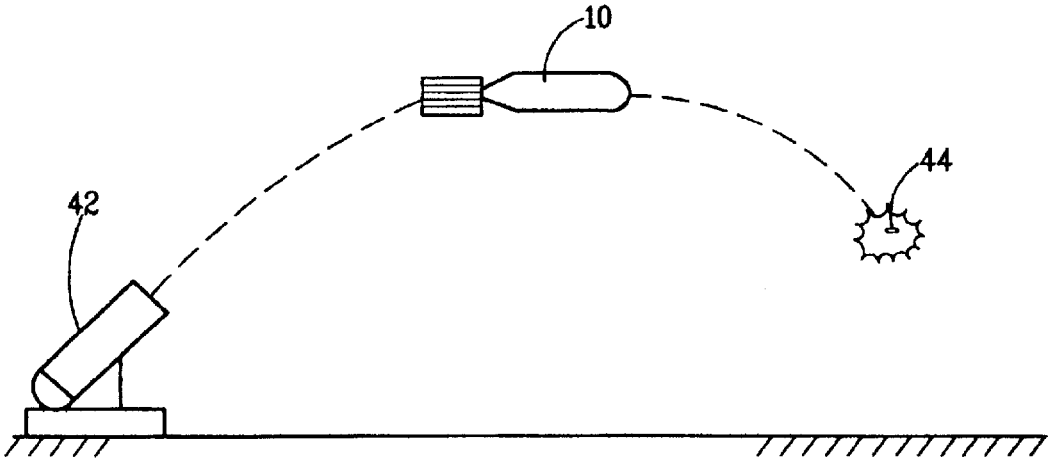
FIGS. 4A–4D show how the inventive projectile is deployed.
Figure 4B:
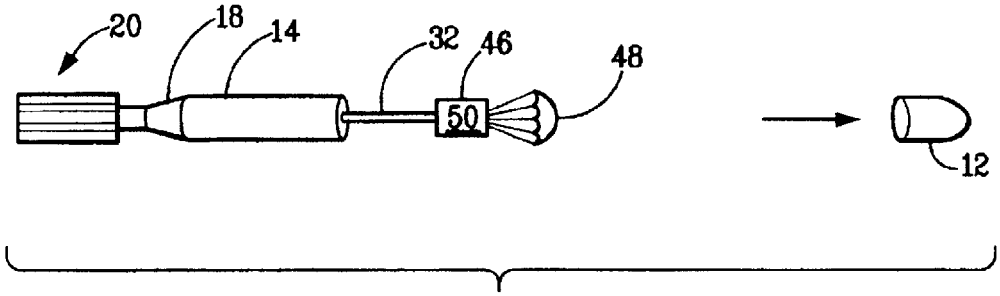

FIGS. 4A–4D show how the inventive projectile 10 is deployed. In FIG. 4A, projectile 10 is launched from, for example, a mortar launcher. At point 44, the height of burst in the trajectory of projectile 10, fuze 30 is detonated. Fuze 30 produces expanding gases when detonated. The expanding gases push second circular disc 37 into the two half cylinders 34*b*, 34*b*. The two half cylinders 34*b*, 34*b* push on first circular disc 36. First circular disc 36 pushes the half cylinders 34*a*, 34*a*. Half cylinders 34*a*, 34*a* push nose cap 12 to shear pins 13 and eject nose cap 12, parachute assembly 28 and payload 40 from the projectile body 14. See FIGS. 4B and 4C.

Figure 4C:
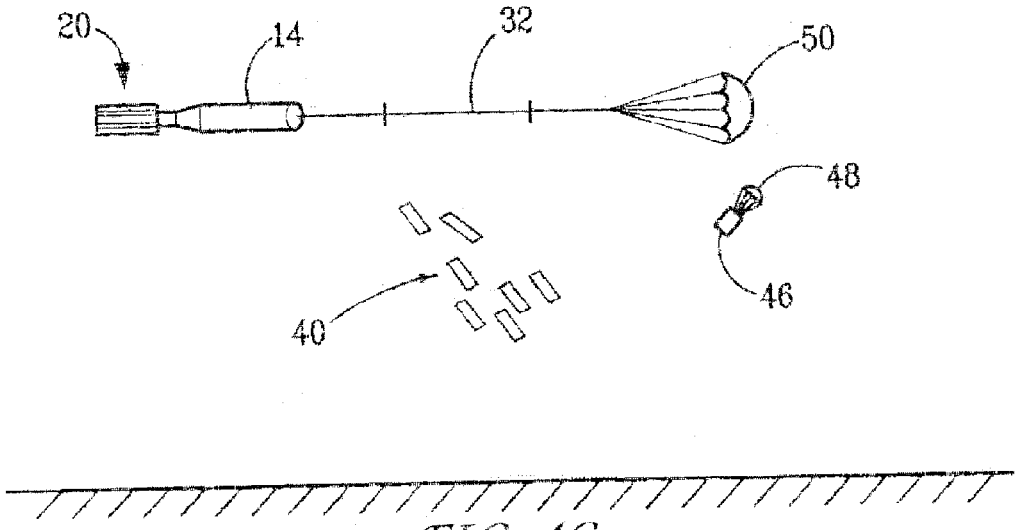
Figure 4D:
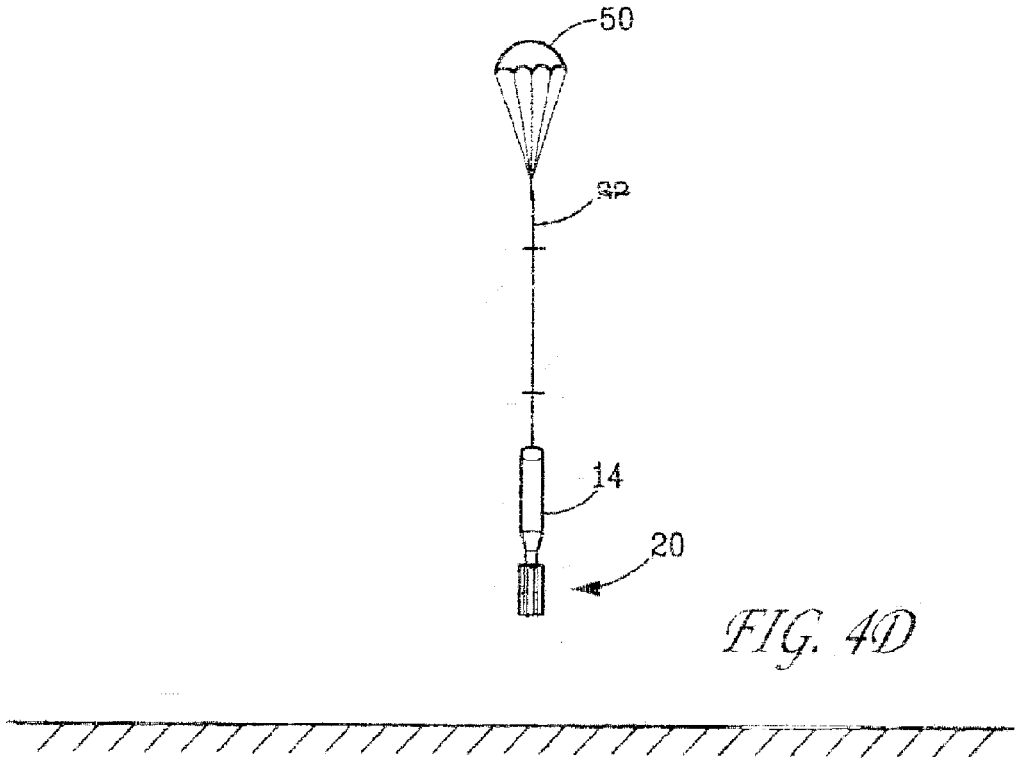

As seen in FIG. 4C, parachute assembly 28 comprises a drogue bag 46, a drogue chute 48 attached to the bag 46 and a main parachute 50 disposed in the drogue bag 46. Main parachute 50 is connected by the cable 32 and swivel 38 to the boattail 18. When parachute assembly 28 is ejected from projectile body 14, the drogue chute 48 opens and pulls drogue bag 46 off of the main parachute 50. Main parachute 50 then opens and controls the descent of the projectile body 14, boattail 18 and fin assembly 20. Nose cap 12 free falls to the ground. Payload 40 also free falls to the ground. Depending on the nature of the payload 40, drag inducing devices may be attached to payload 40, if desired. Main parachute 50 is sized so that the terminal velocity of the remains of projectile 10 is predetermined. FIG. 4D shows the main parachute 50 attached to the remains of projectile 10 and descending to the ground.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A non-lethal cargo projectile, comprising:

a projectile body;

a nose cap attached to a front of the projectile body;

a boattail attached to a rear of the projectile body;

a fin assembly including a boom attached to the boattail;

a parachute assembly disposed in a front of the projectile body;

a cable connecting the parachute assembly to the boattail;

a fuze disposed in the boattail;

a first pair of half cylinders disposed in the projectile body behind the parachute assembly;

a first circular disc disposed at a front end of the first pair of half cylinders and a second circular disc disposed at a rear end of the first pair of half cylinders;

a second pair of half cylinders disposed in the projectile body in front of the first circular disc; and a payload disposed in a space defined by the first pair of half cylinders and the first and second circular discs.

2. The projectile of claim 1 further comprising shear pins that connect the nose cap to the front of the projectile body.

3. The projectile of claim 1 further comprising propellant donuts disposed on the boom.

4. The projectile of claim 1 further comprising a swivel connecting the cable to the parachute assembly.

5. The projectile of claim 1 wherein the fuze includes a charge for producing gas.

6. The projectile of claim 1 wherein the payload comprises a non-lethal composition.

7. The projectile of claim 4 wherein the parachute assembly comprises a drogue bag, a drogue parachute attached to the drogue bag, a main parachute disposed in the drogue bag, the main parachute being connected by the cable and swivel to the boattail.

8. The projectile of claim 2 wherein the shear pins comprise one of nylon, wood, and bronze.

9. The projectile of claim 1 wherein the nose cap and the first and second pair of half cylinders comprise plastic.

10. The projectile of claim 1 wherein the projectile body and the first and second circular discs comprise aluminum.

* * * * *